US007780584B2

(12) United States Patent
Alexander

(10) Patent No.: US 7,780,584 B2
(45) Date of Patent: Aug. 24, 2010

(54) LEG EXERCISER

(76) Inventor: Jim Alexander, 5225 York Place, Prince George, BC (CA) V2N 2A4

( * ) Notice: Subject to any disclaimer, the term of this patent is extended or adjusted under 35 U.S.C. 154(b) by 0 days.

(21) Appl. No.: 12/020,002

(22) Filed: Jan. 25, 2008

(65) Prior Publication Data

US 2008/0214371 A1 Sep. 4, 2008

Related U.S. Application Data

(60) Provisional application No. 60/886,626, filed on Jan. 25, 2007.

(51) Int. Cl.
*A63B 21/008* (2006.01)
*A63B 21/00* (2006.01)

(52) U.S. Cl. ..... 482/137; 482/112; 482/145; 482/904

(58) Field of Classification Search ..... 482/62, 482/111, 112, 113, 121–130, 133–138, 145, 482/904, 910; D21/665, 690; 5/621, 624; 297/423.28, 423.3, 423.32, 423.39, 423.4
See application file for complete search history.

(56) References Cited

U.S. PATENT DOCUMENTS 4,240,627 A * 12/1980 Brentham ..... 482/112
4,441,708 A * 4/1984 Brentham ..... 482/112
4,684,126 A * 8/1987 Dalebout et al. ..... 482/138
4,750,736 A * 6/1988 Watterson ..... 482/73
4,809,976 A * 3/1989 Berger ..... 482/130
5,044,633 A 9/1991 Rice
5,104,363 A * 4/1992 Shi ..... 482/73
5,282,748 A * 2/1994 Little ..... 434/254
5,505,679 A * 4/1996 McBride et al. ..... 482/53
5,599,260 A 2/1997 Rovinsky et al.
6,099,445 A 8/2000 Rovinsky et al.
6,196,565 B1 * 3/2001 Chubbuck ..... 280/255
6,334,624 B1 * 1/2002 Giglio ..... 280/304.1
6,916,279 B2 * 7/2005 Endelman ..... 482/137
6,979,284 B2 12/2005 Curtis
7,223,220 B2 * 5/2007 Bendavid et al. ..... 482/130
7,387,598 B2 * 6/2008 Miller ..... 482/112
7,445,586 B2 * 11/2008 Gibson ..... 482/142
7,569,002 B2 * 8/2009 Nativ ..... 482/92
2004/0053756 A1 3/2004 Tremayne
2004/0138034 A1 * 7/2004 Endelman ..... 482/121
2004/0142797 A1 7/2004 Andre
2005/0233875 A1 * 10/2005 Clarke et al. ..... 482/123
2007/0037677 A1 * 2/2007 Splane ..... 482/121
2007/0197356 A1 * 8/2007 Miller ..... 482/112

* cited by examiner

*Primary Examiner*—Loan Thanh
*Assistant Examiner*—Daniel F Roland
(74) *Attorney, Agent, or Firm*—Oyen Wiggs Green & Mutala LLP

(57) ABSTRACT

An exercise device comprising a chair attachment assembly adapted for attachment to a chair at a location under a seat of the chair and configured to extend outwardly therefrom. A pair of leg supports are pivotally coupled at first ends thereof to a pivot point on the chair attachment assembly. Each leg support is independently moveable between a contracted position and an extended position. A leg holder is coupled to each leg support near a second end thereof. A resistance element is pivotally coupled between each leg support and the chair attachment assembly. Each resistance element is configured to provide resistance against both outward movement of the associated leg support from the contracted position to the extended position and inward movement of the associated leg support from the extended position to the contracted position.

9 Claims, 6 Drawing Sheets

LEG EXERCISER

REFERENCE TO RELATED APPLICATION

This application claims priority from U.S. Provisional Patent Application No. 60/886,626, filed 25 Jan. 2007 and entitled "LEG EXERCISER".

TECHNICAL FIELD

This invention relates to exercise machines. Certain embodiments relate to leg exercise machines capable of being attached to or integrated with standard office chairs which can be used for exercising the legs while seated and without interfering with or impeding the performance of office duties.

BACKGROUND

Office work is routinely sedentary. Sedentary work brings with it an increased risk of poor health. Consequently, many office workers seek ways to integrate exercise into their workday.

There exist a number of prior art devices for exercising in chairs, including the following:

U.S. Pat. No. 5,044,633 to Rice;

U.S. Pat. No. 5,599,260 to Rovinsky et al.;

U.S. Pat. No. 6,099,445 to Rovinsky et al.;

U.S. Patent Application Publication No. 2004/0053756 to Tremayne;

U.S. Patent Application Publication No. 2004/0142797 to Andre; and,

U.S. Pat. No. 6,979,284 to Curtis.

The inventor has identified a need for improved exercise devices which may be attached to or incorporated into chairs.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an exercise device comprising a chair attachment assembly adapted for attachment to a chair at a location under a seat of the chair and configured to extend outwardly therefrom. A pair of leg supports are pivotally coupled at first ends thereof to a pivot point on the chair attachment assembly. Each leg support is independently moveable between a contracted position and an extended position. A leg holder is coupled to each leg support near a second end thereof. A resistance element is pivotally coupled between each leg support and the chair attachment assembly. Each resistance element is configured to provide resistance against both outward movement of the associated leg support from the contracted position to the extended position and inward movement of the associated leg support from the extended position to the contracted position.

In one embodiment of the present invention, two adjustable resistance mechanisms, one for each leg, enable each leg to be exercised independently of the other. Additionally, so that the muscles on the top of the leg can be exercised independently from the muscles at the back of the leg, different resistance settings, requiring a different applied force, can be used for stretching the leg outward as opposed to retracting the leg to its original position.

In one embodiment the present invention comprises an exercise device which may be attached to a standard office chair (or built into an existing chair, sofa, bench, etc). The present invention has a chair attachment assembly with a pair of leg supports pivotally attached thereto. Each leg support is independently movable between an extended and a contracted position, and has a leg or ankle holder attached to its outer end. A resistance mechanism, which may comprise a hydraulic cylinder, is coupled to each leg support and resists motion of the associated leg support. The resistance mechanism optionally has an adjustment mechanism to regulate the amount of force required to move the attached leg support. In embodiments wherein the resistance mechanism is a hydraulic cylinder, the adjustment mechanism may comprise an adjustable valve, for example.

Further aspects of the invention and details of specific embodiments are set out below.

BRIEF DESCRIPTION OF DRAWINGS

In drawings which illustrate non-limiting embodiments of the invention.

DESCRIPTION

Figure 1:
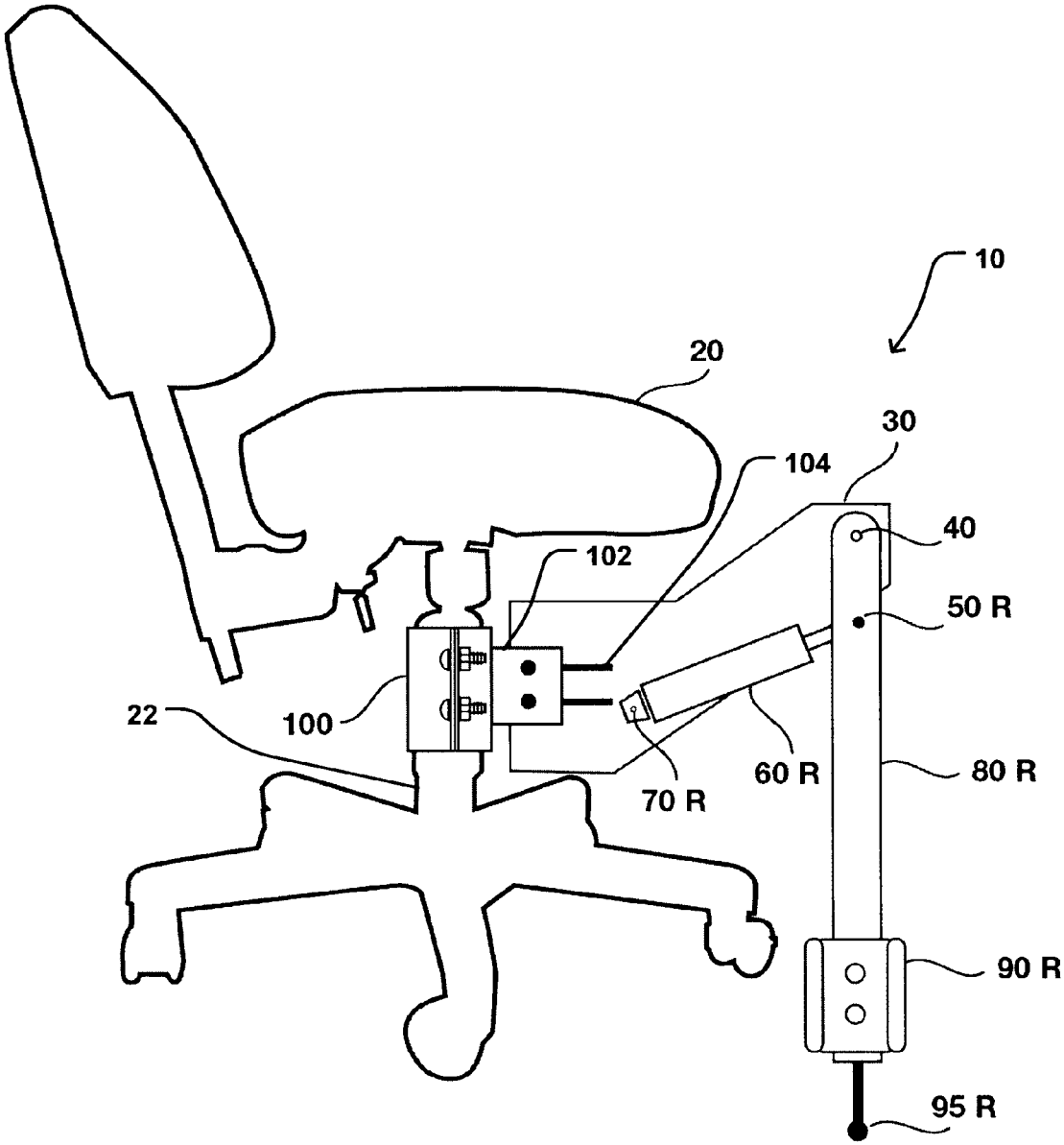
FIG. 1 is a schematic representation of a leg exerciser attached to an office chair according to one embodiment of the invention with both leg supports in a contracted position.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Referring to FIGS. 1-4, one embodiment of the present invention provides a leg exerciser 10 which may be attached to a chair 20 having a central post 22 such as, for example, an office chair. Leg exerciser 10 comprises a chair attachment assembly comprising a main supporting element 30 coupled to a bracket 100 at an inward end thereof. The terms "inward" and "outward" are used herein refer to the directions toward and away from central post 22 of chair 20, respectively. In the illustrated embodiment, bracket 100 comprises a generally cylindrical bracket adapted for mounting leg exerciser 10 to a central post 22 of chair 20, but it is to be understood that bracket 100 may be differently configured for mounting leg exerciser 10 to different types of chairs.

Bracket 100 is coupled to supporting element 30 by a tab 102 extending outwardly from bracket 100 in the illustrated embodiment. Tab 102 may have apertures therethrough for receiving bolts (not specifically enumerated), which also are received through slots 104 defined in supporting element 30. Slots 104 allow a user to adjust the position of supporting element 30 inwardly and outwardly with respect to chair 20 by loosening the bolts, sliding supporting element to the desired position, and then tightening the bolts. In other embodiments, bracket 100 could be integrally formed with supporting element 30, or could be coupled to supporting element 30 by other mechanisms.

A pair of leg supports 80L and 80R are pivotally attached to supporting element 30 at a pivot point 40 near an outward end of supporting element 30. Left leg support 80L is not visible in FIG. 1, since left leg support 80L is hidden behind right leg support 80R. Left leg support 80L is visible in FIG. 2, which shows right leg support 80R in an extended position. In the illustrated embodiment, leg supports 80L and 80R are coupled to supporting element 30 by means of a pin 42 (see FIG. 3) inserted through apertures in leg supports 80L and 80R and supporting element 30, and spacers 44 (see FIG. 3) are provided to maintain a desired separation between leg supports 80L and 80R and supporting element 30.

Pivot point 40 is preferably located at a height approximately equal to a height of the seat of chair 20. In the illustrated embodiment, a user may adjust the position of supporting element 30 inwardly or outwardly, as discussed above, such that pivot point 40 is positioned approximately on a line passing through the user's knee joints. In embodiments wherein the position of supporting element 30 with respect to chair 20 is not adjustable, supporting element 30 may be provided with a plurality of apertures (not shown) in different locations for receiving pin 42 (see FIG. 3), to allow the user to position pivot point 40 close to a line passing through the user's knee joints.

Figure 4:
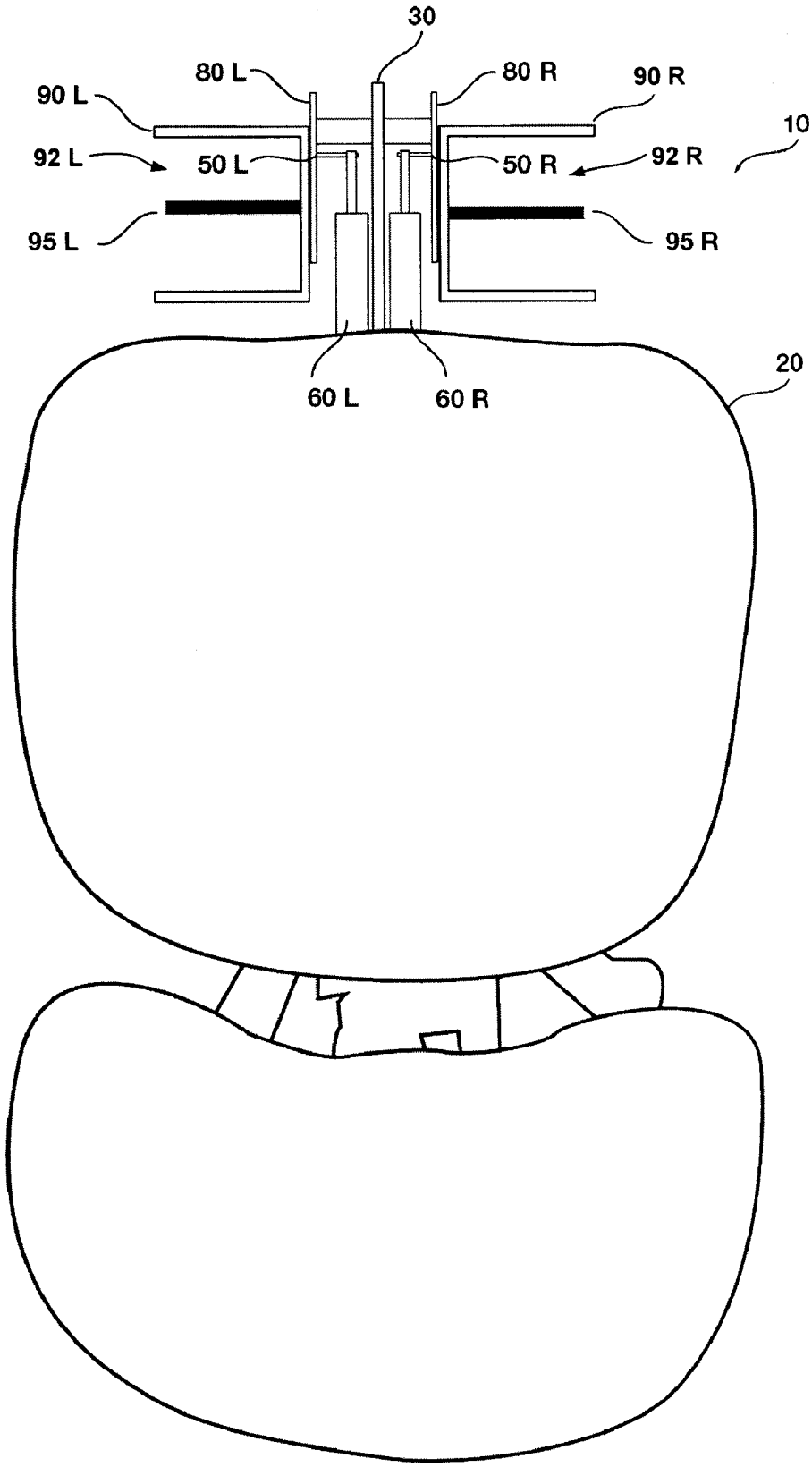
FIG. 4 is a top view of the leg exerciser of FIG. 1.

Each of leg supports 80L and 80R has a leg holder coupled thereto. In the illustrated embodiment, the leg holders comprise left and right leg grippers 90L and 90R which are respectively attached to leg supports 80L and 80R near the ends thereof opposite pivot point 40 (i.e., near the lower ends of leg supports 80L and 80R). Leg grippers 90L and 90R are shaped to receive a user's leg or ankle to facilitate pushing and pulling the leg supports 80L and 80R. As shown in FIG. 4, leg grippers 90L and 90R define leg receiving recesses 92L and 92R, respectively. Leg grippers 90L and 90R may be positioned such that the distance between leg receiving recesses 92L and 92R is suitable for receiving lower portions of a user's legs. Leg grippers 90L and 90R may be padded for the comfort of the user. Alternatively, the leg holders could comprise straps or the like for wrapping around the user's legs or ankles.

Footrests 95L and 95R may be respectively attached to the lower ends of leg supports 80L and 80R. In some embodiments, footrests 95L and 95R may be removable from leg supports 80L and 80R, or may be foldably coupled to leg supports 80L and 80R so that a user may fold footrests 95L and 95R up and out of the way when they are not desired. In some embodiments, footrests 95L and 95R may have a construction similar to footrests of a motorcycle.

Left and right resistance elements 60L and 60R are pivotally coupled between supporting element 30 and leg supports 80L and 80R, respectively. The inward ends of resistance elements 60L and 60R are pivotally attached to supporting element 30 at attachment points 70L and 70R, respectively. The outward ends of resistance elements 60L and 60R are pivotally attached to leg supports 80L and 80R at attachment points 50L and 50R, respectively. Attachment points 50L and 50R may be located between pivot point 40 and leg grippers 90L and 90L, respectively. In some embodiments, attachment points 50L and 50R may be located closer to pivot point 40 than to leg grippers 90L and 90L.

Resistance elements 60L and 60R provide resistance against both outward and inward movement of leg supports 80L and 80R. Resistance elements 60L and 60R may include adjustment mechanisms for individually varying the amount of force required to move leg supports 80L and 80R. The adjustment mechanisms may also permit different amounts of force to be required for outward movement of leg supports 80L and 80R than for inward movement of leg supports 80L and 80R. Resistance elements 60L and 60R may comprise, for example, hydraulic or pneumatic cylinders, and the adjustment mechanisms may comprise adjustable valves.

Figure 2:
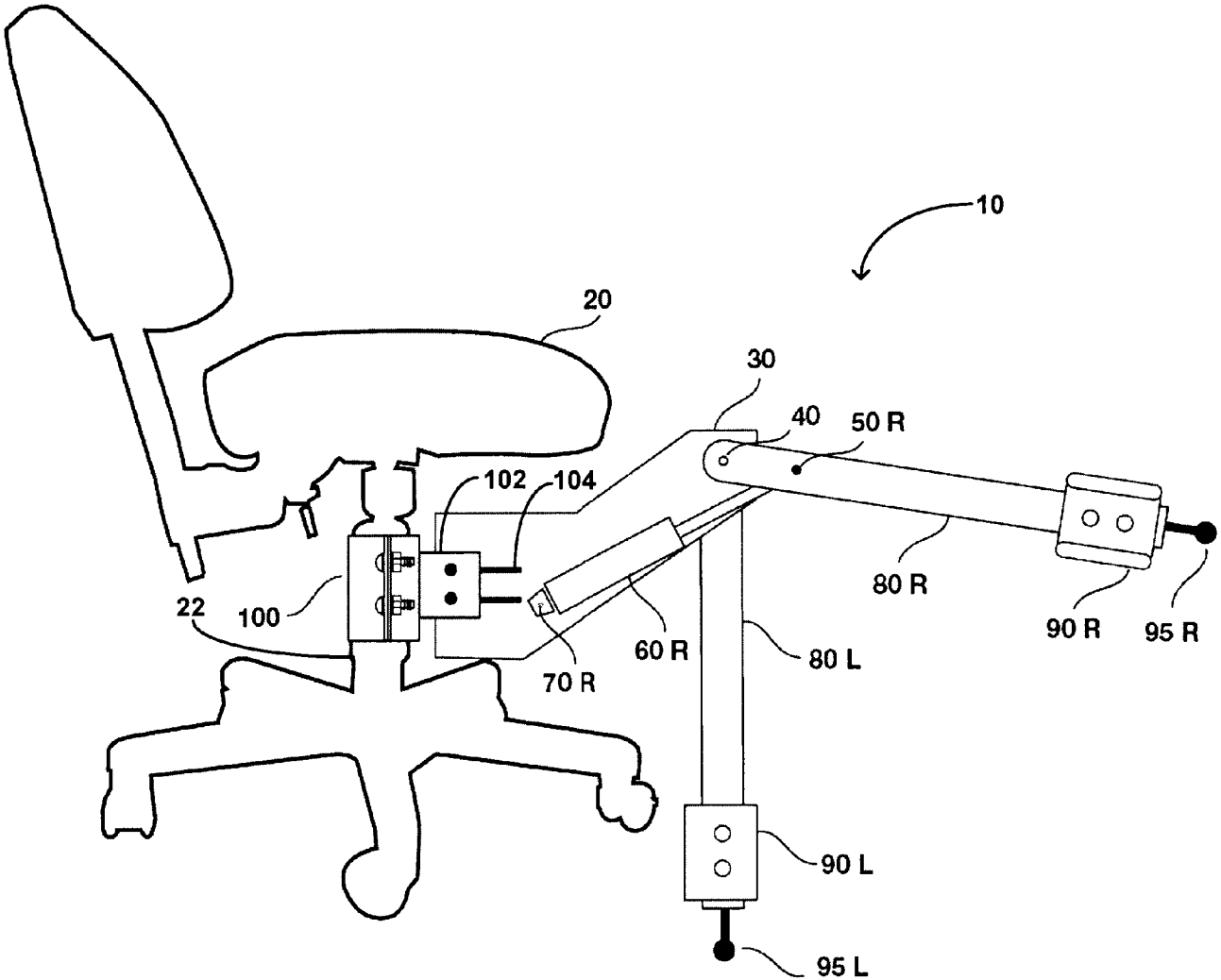
FIG. 2 shows the leg exerciser of FIG. 1 with the right leg support in an extended position
Figure 3:
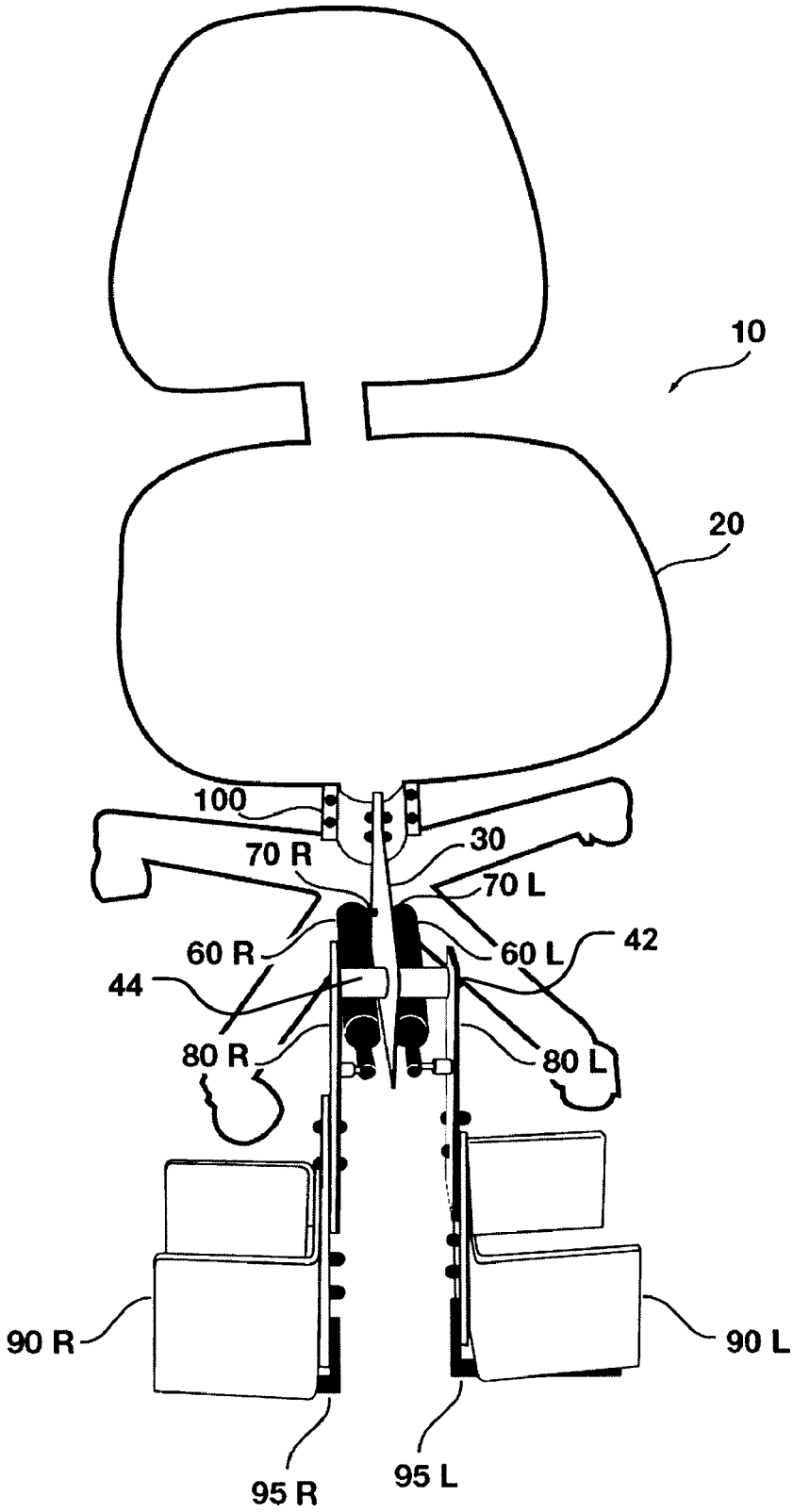
FIG. 3 is a front view of the leg exerciser of FIG. 1.

In operation, when a user is seated in chair 20, the right leg is slipped into right leg gripper 90R and the left leg in slipped into left leg gripper 90L with both leg supports 80L and 80R in the contracted position shown in FIG. 1. To begin exercising, the user extends their right leg, for example. In so doing, the leg pushes against leg gripper 90R and moves leg support 80R in a direction rotationally away from the seated user to an extended position, as shown in FIG. 2. After the right leg is fully extended, the exerciser begins to push the left leg against gripper 90L while contracting the right leg against gripper 90R. This cycle may be repeated for as long as the exerciser desires. Alternatively, leg exerciser 10 could be used by extending and contracting both legs at the same time.

Figure 5:
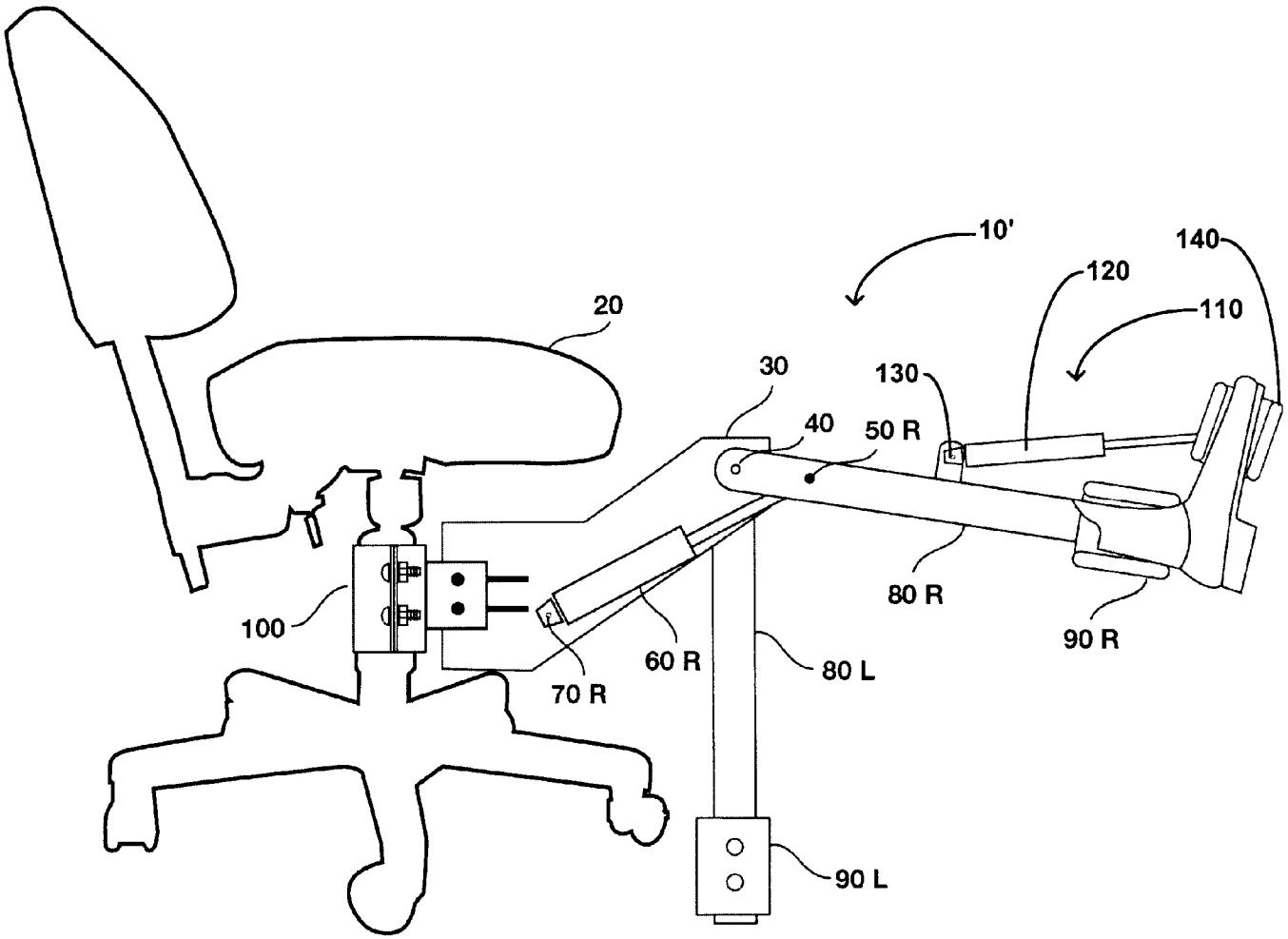
FIG. 5 is a schematic representation of a leg exerciser attached to an office chair according to another embodiment of the invention.

FIG. 5 shows a leg exerciser 10' according to another embodiment of the invention. Leg exerciser 10' is the same as leg exerciser 10 of FIGS. 1-4, except that leg exerciser 10' comprises a calf exerciser mechanism 110 attached to right leg support 80R. Another calf exerciser mechanism 110 may be attached to left leg support 80L but has been omitted from FIG. 5 to avoid cluttering the drawing.

Calf exerciser mechanism 110 comprises a resistance element 120 pivotally attached to right leg support 80R at attachment point 130. Resistance element 120 may comprise, for example, an adjustable hydraulic or pneumatic cylinder similar to resistance elements 60L and 60R. A foot gripper 140 is attached to the end of resistance element 120 opposite attachment point 130.

In operation, a user seated in chair 20 places their foot in foot gripper 140. The user may then exercise their calf muscles by raising and lowering their toes, such that their foot pulls and pushes on foot gripper 140, which in turn contracts and extends resistance element 120.

Figure 6:
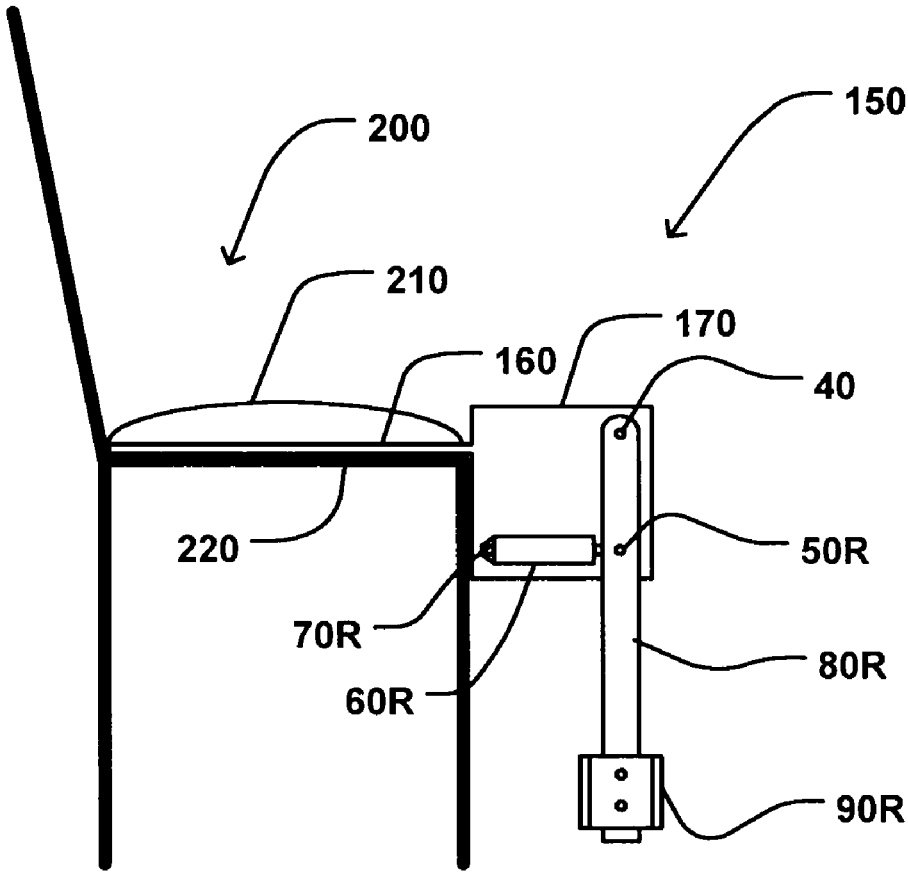
FIG. 6 is a schematic representation of a leg exerciser attached to a chair according to another embodiment of the invention; and, FIG. 7 shows the attachment assembly of the FIG. 6 embodiment in isolation.
Figure 7:
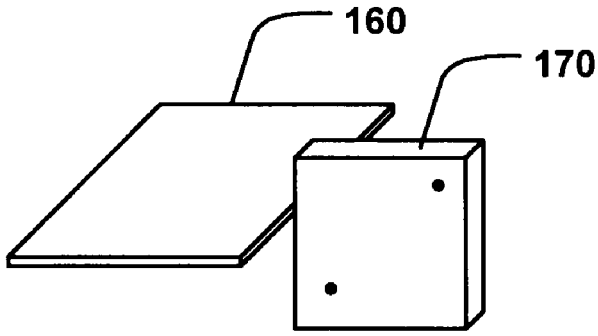

FIG. 6 shows a leg exerciser 150 according to another embodiment of the invention. Leg exerciser 150 is adapted for use with a chair 200 having a seat 210 coupled to a frame 220. In the FIG. 6 embodiment, the chair attachment assembly comprises an attachment plate 160 coupled to a supporting element 170. FIG. 7 shows attachment plate 160 and supporting element 170 in isolation. Attachment plate 160 is configured to be attached between seat 210 and frame 220 of chair 200. The remaining components of leg exerciser 150 are equivalent to those of leg exerciser 10 described above with reference to FIGS. 1-4 (and are identified with the same reference characters), and are not described again to avoid repetition.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An exercise device comprising:

a chair attachment assembly adapted for attachment to a chair at a location under a seat of the chair and configured to extend outwardly therefrom;

a pair of leg supports pivotally coupled at first ends thereof to a pivot point on the chair attachment assembly, each leg support independently moveable between a contracted position and an extended position;

a leg holder coupled to each leg support near a second end thereof, each leg holder configured to receive a lower portion of a user's leg such that inward and outward movement of the user's leg causes inward and outward movement of the associated leg support; and, a resistance element pivotally coupled between each leg support and the chair attachment assembly, each resistance element configured to provide resistance against both outward movement of the associated leg support from the contracted position to the extended position and inward movement of the associated leg support from the extended position to the contracted position, wherein the chair attachment assembly comprises a bracket adapted for mounting to a central post of the chair and a supporting element coupled to the bracket.

2. An exercise device according to claim 1 wherein the pivot point on the chair attachment assembly is located at a height approximately equal to a height of the seat of the chair.

3. An exercise device according to claim 1 wherein the leg holders comprise leg grippers, each leg gripper defining a leg receiving recess positioned to receive a lower portion of a user's leg.

4. An exercise device according to claim 1 wherein each resistance element comprises a hydraulic cylinder or a pneumatic cylinder.

5. An exercise device according to claim 1 comprising a calf exerciser mechanism coupled to at least one of the leg supports.

6. An exercise device according to claim 5 wherein the calf exerciser mechanism comprises a secondary resistance element pivotally coupled between an attachment point on the associated leg support and a foot gripper.

7. An exercise device according to claim 6 wherein the secondary resistance element is configured to provide resistance against movement of the foot gripper both toward and away form the attachment point on the associated leg support.

8. An exercise device according to claim 6 wherein the secondary resistance element comprises one of a hydraulic cylinder and a pneumatic cylinder.

9. An exercise device comprising:

a chair attachment assembly adapted for attachment to a chair at a location under a seat of the chair and configured to extend outwardly therefrom;

a pair of leg supports pivotally coupled at first ends thereof to a pivot point on the chair attachment assembly, each leg support independently moveable between a contracted position and an extended position;

a leg holder coupled to each leg support near a second end thereof; and, a resistance element pivotally coupled between each leg support and the chair attachment assembly, each resistance element configured to provide resistance against both outward movement of the associated leg support from the contracted position to the extended position and inward movement of the associated leg support from the extended position to the contracted position, wherein the chair attachment assembly comprises a bracket adapted for mounting to a central post of the chair and a supporting element coupled to the bracket, and wherein the bracket comprises a tab extending outwardly therefrom, the tab defining one or more apertures therethrough, and wherein the supporting element has one or more slots defined therein, whereby the supporting element is coupled to the bracket by one or more bolts extending through the one or more apertures and one or more slots, such that a position of the supporting element with respect to the chair is adjustable inwardly and outwardly to permit a user to position the pivot point approximately along a line extending through the user's knee joints.

* * * * *